US006511160B1

(12) United States Patent
Morita et al.

(10) Patent No.: US 6,511,160 B1
(45) **Date of Patent: *Jan. 28, 2003**

(54) THERMAL INK-JET HEAD AND RECORDING APPARATUS

(75) Inventors: Naoki Morita, Ebina (JP); Jun Isozaki, Ebina (JP); Toshinobu Hamazaki, Ebina (JP); Masahiko Fujii, Ebina (JP); Yoshihiko Fujimura, Ebina (JP); Yukihisa Koizumi, Ebina (JP)

(73) Assignee: Fuji Xerox Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/642,869

(22) Filed: May 6, 1996

(30) Foreign Application Priority Data

May 10, 1995 (JP) ..... 7-112097

(51) Int. Cl.[7] ..... B41J 2/05
(52) U.S. Cl. ..... 347/65
(58) Field of Search ..... 347/65, 63, 94

(56) References Cited

U.S. PATENT DOCUMENTS

| | | | | |
|---|---|---|---|---|
| 4,835,553 A | * | 5/1989 | Torpey | 347/65 |
| 4,897,674 A | * | 1/1990 | Hirasawa | 347/94 X |
| 5,041,844 A | * | 8/1991 | Deshpande | 347/65 |
| 5,708,465 A | | 1/1998 | Morita et al. | 347/65 |

FOREIGN PATENT DOCUMENTS

| | | | |
|---|---|---|---|
| EP | 0347856 | * 12/1989 | B41J/3/04 |
| EP | 0594369 | 4/1994 | B41J/2/16 |
| JP | 3-234631 | * 10/1991 | B41J/3/04 |
| JP | 5-131627 | * 5/1993 | B41J/2/05 |
| JP | 5-147211 | * 6/1993 | B41J/2/055 |
| JP | 5-155020 | 6/1993 | B41J/2/05 |
| JP | 6-183002 | 7/1994 | B41J/2/05 |
| JP | 6-183009 | * 7/1994 | B41J/2/05 |
| JP | 6-191030 | 7/1994 | B41J/2/05 |
| JP | 6-210872 | 8/1994 | B41J/2/175 |
| JP | 6-226978 | 8/1994 | B41J/2/05 |
| JP | 6-238904 | 8/1994 | B41J/2/16 |
| JP | 6-270404 | 9/1994 | B41J/2/05 |
| JP | 7-101059 | 4/1995 | B41J/2/05 |
| JP | 7-232433 | 9/1995 | B41J/2/05 |

* cited by examiner

*Primary Examiner*—Sandra Brase
(74) *Attorney, Agent, or Firm*—Oliff & Berridge, PLC

(57) ABSTRACT

A channel wafer has a plurality of nozzle flow channels and a common ink reservoir. Pits communicating with the ink reservoir from above heating elements are formed in a polyimide layer on a heater wafer. Each of the pits has a throttled portion in the rear of the heating element and the terminal of a nozzle flow channel is situated on the throttled portion so as to form the minimum sectional area portion of the flow channel. Stable ink discharge characteristics are attained by means of the flow channel resistance of the minimum sectional area portion and bubble pressure is prevented from being relieved toward the ink reservoir. The pressure propagated to the ink reservoir is made to attenuate internally, so that no crosstalk is produced.

16 Claims, 9 Drawing Sheets

FIG. 2
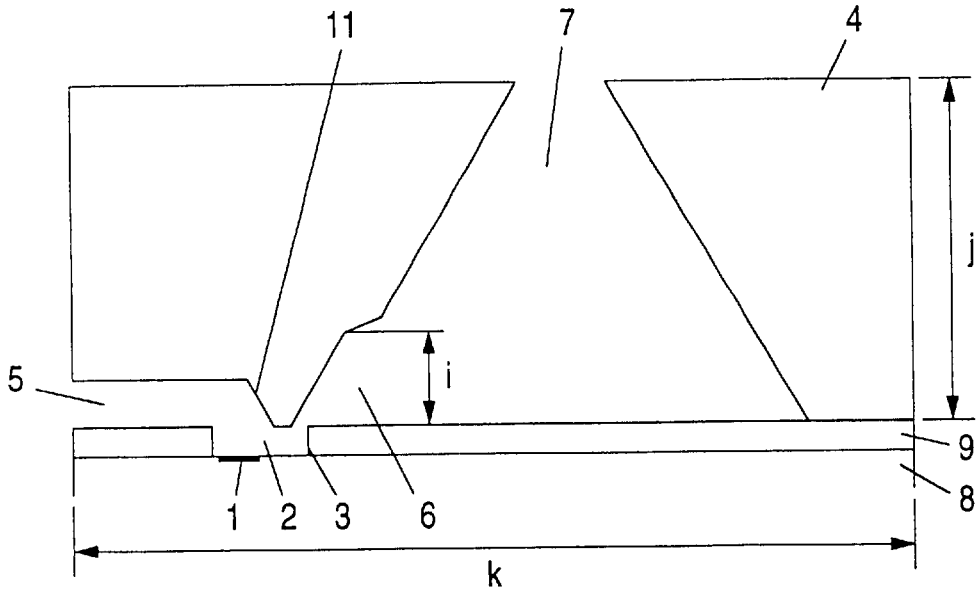
FIG. 3A
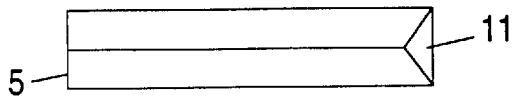
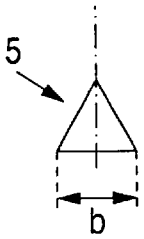
FIG. 3B
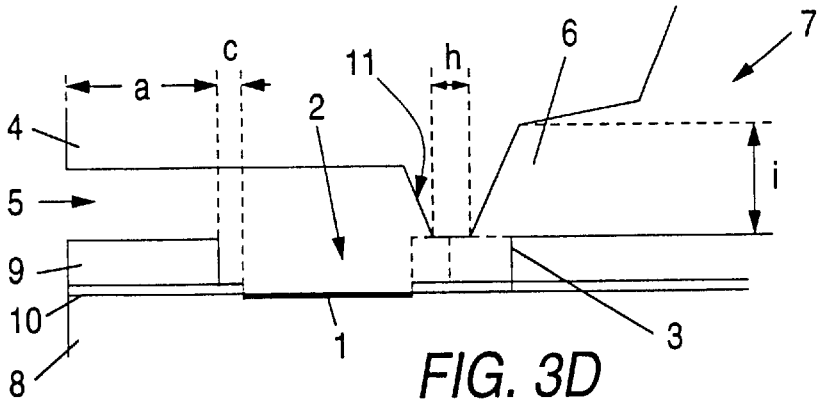
FIG. 3D
FIG. 3C
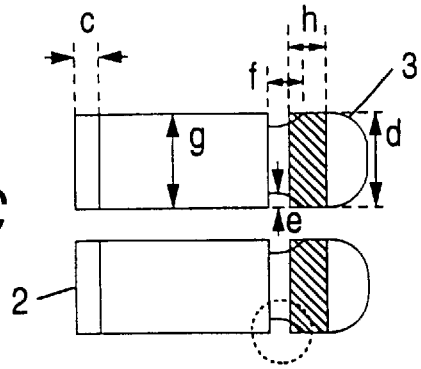

THERMAL INK-JET HEAD AND RECORDING APPARATUS

BACKGROUND OF THE INVENTION

1. Field of Invention

The present invention relates to a thermal ink-jet head for recording data by causing heat generated from bubble-producing resistors to produce bubbles in ink and causing the ink to be discharged by the bubble pressure being produced. More particularly, the invention relates to a structure of an ink flow channel in a thermal ink-jet head.

2. Description of Related Art

In order to achieve high operating speeds in recording apparatuses, such as thermal ink-jet printers a repetitive response capability of the ink-jet head is increased. Also, in order to ensure high quality image, ink drops are made to respond to frequency with a certain stability so as to ensure that they reach the surface of a recording paper. In the case that ink drops are jetted unstably, the time required for the ink drops to reach the surface of the recording paper and the direction in which they streak tend to vary widely, thus resulting in lower image quality.

The technology of improving image quality includes increasing density and integration. More specifically, in order to increase image quality the nozzles of the thermal ink-jet head are arranged at a pitch corresponding to dot density. As such, the pitch of the nozzles are decreased. However, when the pitch of the nozzles is adjusted in the above manner, nozzle-to-nozzle crosstalk is created. This crosstalk creates image quality defects as discussed below.

The pressure applied to adjoining nozzles is naturally supplied through a common flow channel behind the nozzles. In order to suppress the crosstalk, bubble pressure of jetting ink is supplied to the nozzle efficiently so as to reduce the pressure supplied through the common flow channel. Therefore, an ink flow channel is preferably structured so that the backward pressure relief from a pressure source is minimized with respect to the nozzle.

Unexamined Patent Publication No. 226978/1994 discloses an apparatus that increases energy directed to the nozzle side by placing a conductance regulating wall in an ink cavity. However, the conductance regulating wall simultaneously interferes with a refill of ink due to an increase in flow channel resistance. This also lowers the response frequency. Accordingly, this combination results in unstable printing.

Another method of suppressing crosstalk is to ease the pressure supplied backward from the nozzle by creating a proper flow channel structure. Unexamined Patent Publications No. 210872/1994 and No. 191030/1994 discloses a buffer chamber with a gas enclosed therein so as to control impedance. However, this structure is complicated and a new instability factor arises from handling gas.

Patent Application No. 307221/1994, discloses a communicating flow channel provided between a nozzle flow channel and an ink reservoir together with grooves extending from a heating element up to the communicating flow channel. The grooves connect the ink reservoir and the communicating flow channel and secure a response capability by promoting a refill of ink. The grooves further catch dust creeping into the flow channel. Accordingly, this apparatus attains a high frequency response capability while also trapping dust. However, this apparatus fails to eliminate the crosstalk because pressure is supplied via the communicating flow channel situated in the rear of a heating element. Thus, by using the apparatus of Patent Application No. 307221/1994, dust has completely been prevented from creeping in the flow channel and the necessity for installing filters in chip flow channels has been eliminated.

Lowering ink flow channel resistance as a method for promoting refill of ink has also been considered. However, printing defects will be produced if the flow channel resistance is significantly lowered. For example, FIG. 16 is a diagram illustrating a dropout defect and FIG. 17 is an enlarged view of a dropout defect portion. As seen in FIG. 16, a dropout defect in the form of a whiteline occurs in the vicinity of the head of a solidly printed portion when solid printing is carried out at a high frequency. As seen in FIG. 17, the appearance of such a white line is caused by the shifting of dot positions. The white line is detected when several dots are shifted in the beginning of printing before dots are stably printed. This mechanism allows the white line to occur when high-frequency printing is performed. Therefore, image quality defects can be avoided by stabilizing the ink flow in the beginning of printing. Avoiding such defects is also accomplishable by putting fluid vibration quickly to the static condition after ink is jetted. In other words, it is possible to decrease the image quality defect by providing sufficient flow channel resistance to suppress the ink vibration. Further, the flow channel resistance is usable for suppressing the backward pressure supplied.

The flow channel structure should be uniformly formed. Unexamined Patent Publication No. 238904/1994 describes a method of uniformly forming a flow channel through a multi-state process. However, by using this design an increase in cost is incurred.

As disclosed in Unexamined Patent Publications No. 155020/1993, No. 183002/1994 and No. 270404/1994, further attempts have been made to improve performance by providing a plurality of kinds of grooves or recesses in a thick-film synthetic resin layer between a channel substrate and a heating substrate. However, in order to have a certain degree of reliability, strict precision is required to form such grooves and recesses. This increases the cost of manufacture.

SUMMARY OF THE INVENTION

An object of the invention provides a thermal ink-jet head to improve frequency response capability without causing crosstalk and an increase in manufacturing costs while keeping a chip small in size, and a recording apparatus.

A thermal ink-jet head according to an aspect of the invention comprises a heater substrate having heating elements that produce bubbles and a channel substrate having a plurality of nozzle flow channels, an ink reservoir and a plurality of ink supply ports. The nozzle flow channel is formed in the channel substrate and is disposed above the heating elements and formed up to an end portion of the heating elements. An ink flow channel is at least provided in the heater substrate. The ink flow channel extends from the end of the heating element to the ink reservoir. A sectional area of the ink flow channel increases from the nozzle flow channel to the ink reservoir. A throttle portion is formed in the ink flow channel. The throttle has a smaller cross sectional area proximate to the heating element than the ink reservoir. In embodiments of the invention, the sectional area of the ink reservoir starting from the ink supply port toward the nozzle flow channel may be decreased. Further, the ink reservoir may be used for a plurality of nozzle flow channels.

In embodiments, the sectional areas of the ink flow channel between the end of the heating elements and the ink reservoir may be reduced in the direction in which the nozzle extends. At this time, the nozzle flow channel may have a tilted side extended in a direction perpendicular to the direction in which the nozzle flow channel is orientated and the direction in which the nozzle flow channel is extended. Also, the ink-reservoir-side terminal of the tilted side may be situated above the portion of the ink flow channel where its sectional area is reduced.

According to another aspect of the invention, a thermal ink-jet head comprises a heater substrate having heating elements that produce bubbles and a channel substrate having a plurality of nozzle flow channels. An ink reservoir and a plurality of ink supply ports is also provided. The channel substrate is formed with at least the plurality of nozzle flow channels each extending to the end of the heating elements. The ink supply ports and the ink reservoir are used with the plurality of nozzle flow channels. A sectional area of the ink reservoir communicating with the ink supply ports is increased from the ink supply port toward the nozzle flow channel. A synthetic resin layer is provided on the heater substrate and the heating elements are also provided thereon. A throttle is provided in the heater substrate. The throttle extends from the end of the heating elements to the ink reservoir. A sectional area of the throttle decreases in the direction in which the nozzle flow channel is orientated within the distance from the end of the heating element to the ink reservoir.

According to embodiments, a recording apparatus uses the thermal ink-jet head.

According to embodiments, the sectional area of the ink flow channel is formed with a partition wall between the nozzle flow channel and the ink reservoir formed in the channel substrate. Therefore, the bubble pressure produced on the heating elements acts favorably on the nozzle side since the sectional area of the flow channel proximate to the end of the heating element is minimized, whereby the backward propagation of the pressure can be reduced. As the bubble pressure is efficiently utilized for the discharge of ink drops, sufficient ink-jetting force is secured and the operation is stabilized. Thus improvement in the drive frequency and image quality is accomplishable. Although it is feared that a refill of ink is impeded in the portion where the sectional area is minimized, the ink is only caused to linearly move from between the ink flow channel and the ink reservoir after the bubble dies out as the ink flow channel on the heating element is extended up to the ink reservoir. Consequently, a refill of ink is conducted on the heating element and the ink is resupplied speedily and satisfactorily to ensure a high frequency response capability. Thus the bubble pressure is efficiently used to discharge the ink without impeding a refill of ink by placing the least sectional area portion of the flow channel in the rear of the bubble-producing resistor to provide proper flow channel resistance. Since the ink reservoir side has a sufficient impedance component, not only the attraction of air from the nozzle due to the backward pressure propagation caused after the jetting of ink, but also the disturbance based on the correlation between the rear component of the pressure at the time of high-frequency printing and the bubble-producing pressure is quickly suppressible. Moreover, image quality is made improvable by precisely controlling the dot position as the discharge of ink is stabilized.

Further, even the pressure propagated via the ink flow channel to the ink reservoir is diffused and absorbed into the ink reservoir, whereby crosstalk is reducible. Notwithstanding the provision of the ink reservoir for use common to the plurality of nozzle flow channels, pressure to be propagated to another nozzle is extremely low, so that the influence of crosstalk is obviated.

The aforementioned arrangements are materializable through the conventional process of manufacture only by altering the mask pattern. Therefore, the effects stated above are achievable without any change in cost. As the length of the flow channel is reducible, the number of heads to be laid out per wafer can be increased, which will result in cost reduction. Although a plurality of holes have heretofore been provided in a flow channel corresponding to one nozzle in a heater substrate, only one hole is needed according to the present invention. As a result, not so greater hole-to-hole precision than before is required and this production easier. With the arrangement of providing a synthetic resin layer for a hold as in an aspect of the invention, the thin synthetic resin layer tends to constitute a factor of trouble such as the jutting-out of ink. However, it is intended to minimize an unstable manufacturing factor to decrease the number of holes according to the present invention and this is also led to improving reliability.

With the arrangement of decreasing the sectional area starting with the ink supply port toward the nozzle flow channel in reference to the structure of the ink reservoir as in the second aspect, the diffusion and absorption of the pressure propagated to the ink reservoir are promoted. When the thermal ink-jet head is installed in a recording apparatus, moreover, an ink supply means for supplying ink from an ink tank to an ink supply port is joined to the head. This construction makes it possible to increase the joint area above and form an airtight ink flow channel satisfactorily.

According to embodiments of the invention, the sectional area of the ink flow channel is provided in the heater substrate and extends between the end of the heater element and the ink reservoir and the cross sectional area may be reduced in the direction in which the nozzle is orientated. Therefore, the shape of the bubble produced on the heating elements is regulated in the reduced portion of the ink flow channel while the bubble is growing and the bubble pressure is prevented from being relieved backward, whereby the bubble pressure is efficiently utilizable for ink to be jetted. As the nozzle flow channel has the tilted side extended in a direction perpendicular to the direction in which the nozzle flow channel is orientated and the direction in which the nozzle flow channel is extended, the bubble pressure produced on the heating element can be directed to the opening of the nozzle because of the tilted side with the effect of making the pressure utilizable with efficiency. Further, the ink-reservoir-side terminal of the tilted side is situated above the portion of the ink flow channel where its sectional area is reduced, whereby the sectional area of the ink flow channel is reducible so as to decrease the relief of the bubble pressure toward the ink reservoir. Since the tilted side is positioned close to the heating element or in contact therewith, the bubble can be formed into good shape and the bubble pressure is also efficiently utilizable.

Accordingly, the ink flow channel provided in the synthetic resin layer of the heater substrate contributes to the aforementioned function.

According to other aspects of the invention, the use of the thermal ink-jet head capable of functioning as set forth above makes it possible to put a recording apparatus operating at high speed and offering good image quality to practical use.

BRIEF DESCRIPTION OF THE DRAWINGS

FIG. 2 is a schematic sectional view of the thermal ink-jet head according to the present invention.

FIGS. 3A to 3D are trihedral views showing the structure of a flow channel in the thermal ink-jet head according to the present invention.

DETAILED DESCRIPTION OF PREFERRED EMBODIMENTS

Figure 1:
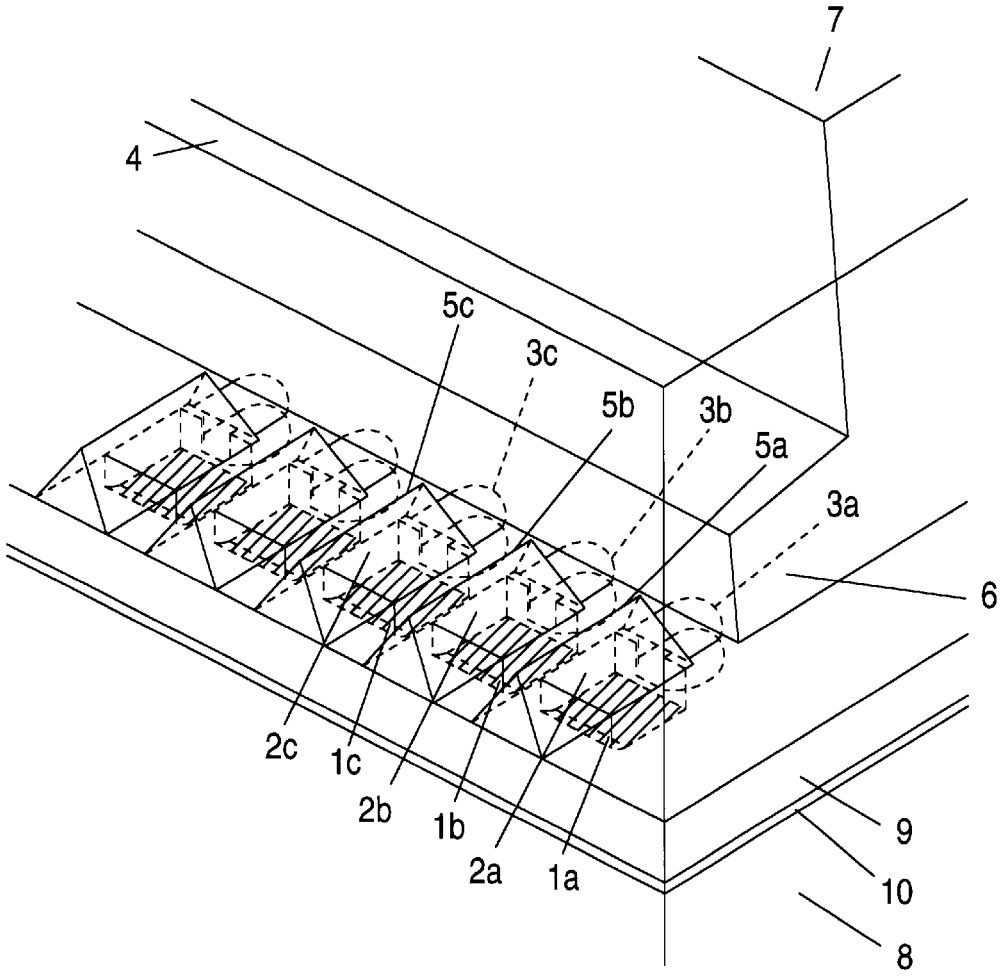
FIG. 1 is a schematic perspective view of a thermal ink-jet head embodying the present invention.

FIG. 1 shows a thermal ink-jet head of the present invention. FIG. 2 shows a sectional view of the ink-jet head. The thermal ink-jet head comprises a channel wafer 4 and a heater wafer 8 having a polyimide layer 9. The heater wafer 8 is made of, for example, Si and formed with a plurality of heating elements 1*a*, 1*b*, 1*c*, . . . , a common electrode (not shown), a discrete electrode and the like. A protective film 10 for protecting the electrodes is formed on the heater wafer 8. The polyimide layer 9 of the heater wafer 8 acts as a synthetic resin layer and is formed on the protective film 10. The Pits 2*a*, 2*b*, 2*c*, . . . are coupled to a forward ink-reservoir portion 6 and are formed above the heating elements 1*a*, 1*b*, 1*c* by etching or the like in the polyimide layer 9. The channel wafer 4 is also made of Si, for example. An ink reservoir 7 having nozzle flow channels 5*a*, 5*b*, 5*c*, . . . and polyimide walls 3*a*, 3*b*, 3*c*, . . . are located proximate to the forward ink-reservoir portion 6. The ink reservoir 7 and the forward ink-reservoir portion 6 are formed by ODE, for example. The nozzle flow channel 5 formed by the ODE is in the shape of a trihedron. The ink reservoir 7 is formed in the shape of a through-hole in the channel wafer 4 by a first ODE and the forward ink-reservoir portion 6 is formed by a second ODE. Thus an ink supply port as a hole formed in the channel wafer 4 has a small aperture and an area where the port makes contact with an ink supply means (not shown) is enlarged. In embodiments, the ink reservoir 7 may be formed by the first ODE in this case without providing the forward ink-reservoir portion 6.

As seen in FIG. 2, the ink is provided through an opening of the ink reservoir 7 at the top thereof. The ink then follows a path to the forward ink reservoir 6 past an internal recess and into the pit 2. The internal recess includes a side wall of the forward ink reservoir 6 and the channel pressure wall 11. The lower portion of the internal recess is tapered inward with respect to the upper portion thereof. In preferred embodiments, the lower portion of the internal recess is located at substantially the upper surface of the polyimide layer 9. Below the internal recess wall and communicating between the ink reservoir 6 and the nozzle flow channel 5 is an ink flow channel. Part of the ink flow channel is throttled so that a sectional area decreases as it approaches the nozzle flow channel 5 from the ink reservoir 6. The ink then passes by the heating element 1 and through the nozzle flow channel 5. In preferred embodiments, the heating element 1 extends from a cut-away section of the polyimide layer, as described further below, to the tapered portion of the channel pressure wall 11. However, the pit 2 extends past the tapered lower portion of the internal recess.

As seen in FIGS. 3A to 3D, the heating element 1, the pit 2, a polyimide wall 3, the channel wafer 4, the nozzle flow channels 5, and the channel pressure wall 11 are provided. The polyimide layer 9 is disposed on a side of the heating element 1 and the pit 2. The pit 2 forms a throttled portion by horizontally throttling the flow channel in the rear of the heating element 1. A small part of the polyimide layer 9 on the side of the heating element 1 and proximate to the pit 2 is cut-away. In embodiments, the mask pattern of the polyimide layer 9 is designated along a contour of the pit 2. An endmost portion of the channel pressure wall 11 of the nozzle flow channel 5 is positioned above the throttled portion. The throttled portion is gradually narrowed from the side of the ink reservoir 7 toward the heating element 1 and a horizontal portion decreases in size after the heating element 1. Thus, the flow channel resistance in ink is reduced when a refill of ink is conducted, whereas the bubble pressure produced on the heating element 1 is prevented from being relieved backward. Also, the growth of a bubble is controlled.

Figure 6A:
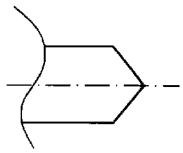
FIGS. 6A and 6B are partial enlarged views of a design polyimide mask pattern by way of example.
Figure 6B:
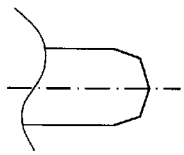

The polyimide wall 3 formed at the joint between the pit 2 and the ink reservoir 7 is semicircular. The endmost portion of the pit 2 acts as a pressure reflective wall against the bubble pressure produced in the heating element 1. By making this portion a pressure-wave absorption structure a reduction in crosstalk is also accomplished. When the circular structure is designed, a polygonal structure is employed for a polyimide mask pattern. FIGS. 6A and 6B are examples of partial enlarged views of a polyimide mask pattern. FIGS. 6A and 6B show the simplest mask patterns, triangular and pentagonal, respectively. Therefore, such a mask pattern is not necessarily a complete semicircle but designed as what is decaoctagonal according to the embodiment of the invention. Due to the restriction of resolution, the polyimide wall 3 remains substantially semicircle.

Figure 16:
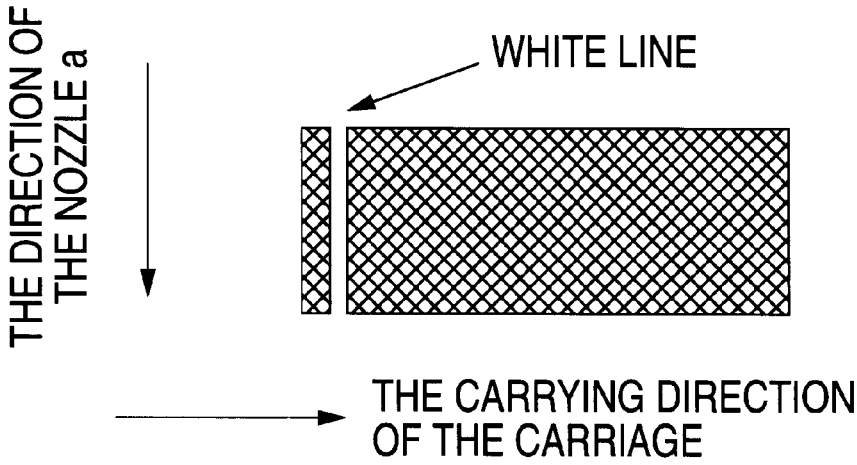
FIG. 16 is a diagram illustrating a dropout defect.
Figure 17:
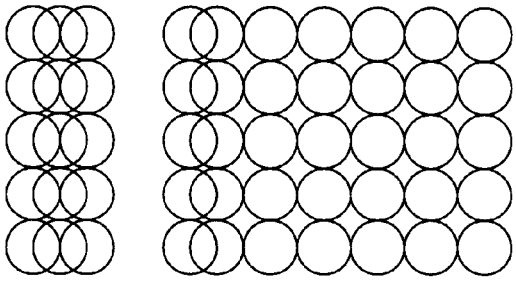
FIG. 17 is an enlarged view of a dropout defect portion.

The unetched portion between the nozzle flow channel 5 and the ink reservoir 7 is disposed so that its end on the side of the nozzle flow channel 5 is located above the throttled portion of the pit 2. The ink flow channel formed with the unetched and throttled portion corresponds to what has the minimum sectional area of this head. Because of the flow channel resistance in this portion, ink vibration is suppressed when printing is started as illustrated in FIGS. 16 and 17. Thus, any defect such as a dropout in an image can be prevented. Moreover, pressure passing through that portion and propagating toward the ink reservoir can be minimized. The flow channel resistance varies with the position of the end of the unetched portion on the side of the nozzle flow channel 5. Moderate flow channel resistance can be set by controlling that position.

Figure 5:
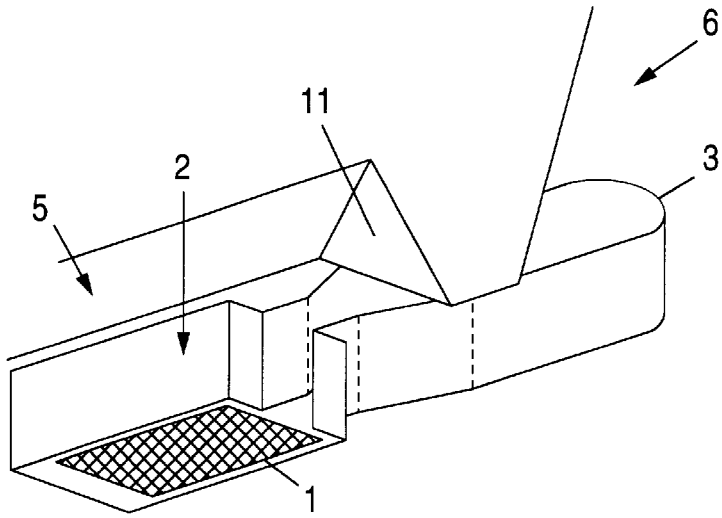
FIG. 5 is an enlarged perspective view of a portion near the pit in the thermal ink-jet head according to the present invention.

The tapered channel pressure wall 11 is formed at the terminal of the nozzle flow channel 5 formed by the ODE. As seen in FIG. 5, the channel pressure wall 11 is used to form the flow channel having the minimum sectional area in the throttled portion of the pit 2. Accordingly, the channel pressure wall 11 is capable of expanding the flow channel three-dimensionally. Thus, the total sectional area of the flow channel is increased. As the channel pressure wall 11 is extended up to the vicinity of the end portion of the heating element 1, it not only controls the growth of the bubble produced on the heating element 1 but also functions as a reflector for reflecting the bubble pressure toward an ink discharge port.

As seen in FIGS. 2 and 3A–3D, the ink flows from the ink reservoir 7 via the pit 2 to the nozzle flow channel 5. The ink that has flowed into the pit 2 is passed through the throttled portion before being supplied onto the heating element 1. At this time, the ink passes through the minimum section area under the unetched portion between the nozzle flow channel 5 and the ink reservoir 7. By following this path proper flow channel resistance is achieved which suppresses the ink vibration when the ink is driven at a high drive frequency. Since the flow channel has been enlarged three-dimensionally by the channel pressure wall 11, the total sectional area of the flow channel is increased, but the flow channel resistance remains unchanged. When the bubble produced on the heating element 1 dies out, the ink linearly flows into the nozzle flow channel 5 along the channel pressure wall 11. Although the flow channel resistance is present when the ink passes through the minimum sectional area under the unetched portion, the ink still flows smoothly. As a refill of ink is accomplished satisfactorily, the frequency response capability of the ink is never deteriorated.

Figure 7A:
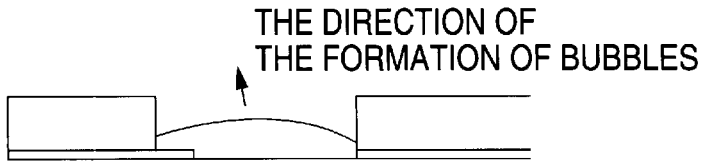
FIGS. 7A and 7B are illustration of the formation of bubbles by way of example.
Figure 7B:
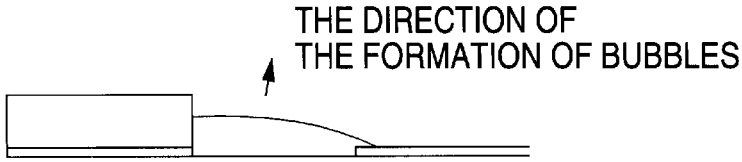

When a bubble is produced on the heating element 1 of the present embodiment, a good bubble is formed due to the pit 2 around the heating element 1. FIGS. 7A and 7B illustrate the formation of bubbles by way of example. FIG. 7B shows a bubble formation of the prior art. In the case of a conventional thermal ink-jet head, for example, as described in Patent Application No. 269899/1993, the pits 2*a*, 2*b*, 2*c*, . . . are directly coupled to the common slit from above the heating elements 1*a*, 1*b*, 1*c*, . . . For this reason, the forward pit wall is used to control the growth of the bubble and the rear side of the heating element is set free. As a result, the bubble grows backward as shown in FIG. 7B. That is, the pressure is caused to be relieved toward the rear side. However, referring to FIG. 7A, according to the embodiment of the invention, the front of the heating element 1 is slightly cut out and the rear thereof is throttled so that the growth of the bubble is controlled in such a way that it is substantially turned in the direction in which the ink is discharged. Further, the bubble is grown along the channel pressure wall 11 and the pressure generated by the growth of the bubble is caused to act toward the ink discharge port. Therefore, the bubble pressure is efficiently utilizable.

The backward propagation of the pressure is beyond the throttled portion of the pit 2 is then minimized by the throttled portion of the pit 2 and the channel pressure wall 11. The pressure propagated beyond the throttled portion of the pit 2 collides with the semicircular polyimide wall 3 of the pit 2 and attenuates. Further, the pressure propagating in the direction of the forward ink-reservoir portion 6 after turning its direction at that point attenuates after diffusing along the forward ink-reservoir portion 6 and the whole tilted side of the ink reservoir 7. The pressure propagating from the throttled portion of the pit 2 is almost canceled when it attenuates in the ink reservoir 7 because the volume of the ink reservoir is far greater than that of the nozzle flow channel 5. Thus, the pressure is prevented from not only propagating into the adjoining nozzle flow channels 5 but also causing crosstalk.

Figure 4:
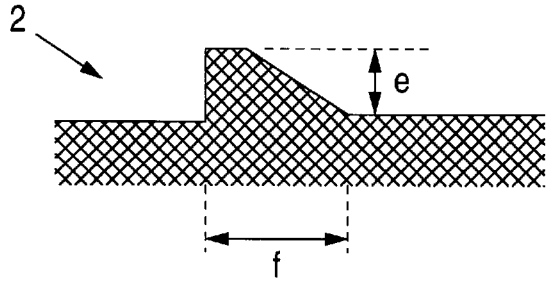
FIG. 4 is a partial enlarged view of a pit in the thermal ink-jet head according to the present invention.

A description will subsequently be given of a specific thermal ink-jet head by reference to FIGS. 2 to 4. The width of the pit 2, that is, the width g of the heat generating area may be set to approximately 6 $\mu$m. The flow channel width d of the throttled portion where the nozzle-channel-side end of the unetched portion between the nozzle flow channel 5 and the ink reservoir 7 is located is approximately 36 $\mu$m. One side e of the throttled quantity of the throttled portion is approximately 14 $\mu$m. The length f of the throttled portion is approximately 30 $\mu$m. In this embodiment, the minimum section area of the flow channel is the product of the flow channel width d and the thickness of the polyimide wall, e.g., 36×25 $\mu$m. The configuration of the polyimide wall 3 of the pit 2 may be decaoctagonal as stated above and close to semicircular. Further, the length c of the cut-out portion on the side of the heating element 1 and proximate to the pit 2 may be set to, for example, 10 $\mu$m. Further, the width b of the bottom of the nozzle flow channel 5 may be a triangular prism and may be approximately 52 $\mu$m and set slightly smaller than the width g of the heat generating area. Further, the length a of the nozzle of the nozzle flow channel 5 may be approximately 30 $\mu$m. Since the tilted side of the nozzle flow channel 5 is formed by the ODE, it forms an angle of 54.7° with the bottom thereof. These ink flow channels may be disposed at a density of approximately 300 spi, for example.

The minimum length h of the unetched portion between the nozzle flow channel 5 and the ink reservoir 7 may be approximately 35 $\mu$m. In the case of the first ODE, etching is carried out to form a through-hole with an etching mask whose size is determined by the ink supply port. The thickness j of the channel wafer 4 is approximately 500 $\mu$m. In the case of the second ODE, an etching mask having an opening greater than that of the etching mask used initially so that the nozzle flow channel 5 together with the ink reservoir 7 is formed. The etching depth i by means of the second ODE is determined by the chip size and may be approximately 60 $\mu$m, the depth being adjustable in accordance with the etching time.

The length of the forward ink-reservoir portion 6 is reducible to substantially zero and the ink reservoir 7 is formed by the first ODE in this case. Even though this portion is set longer, it remains unaffected so long as the flow channel resistance is incomparably lower than that right behind the heater.

The whole length k of the thermal ink-jet head thus prepared with the aforementioned dimensions is approximately 2,000 $\mu$m. In other words, the flow channel length according to the present invention can be reduced by over 100 microns in comparison with any prior system. Therefore, availability is improvable in a ratio of one to 20 chips in a case where a chip of approximately 2,000 microns is employed.

Figure 8:
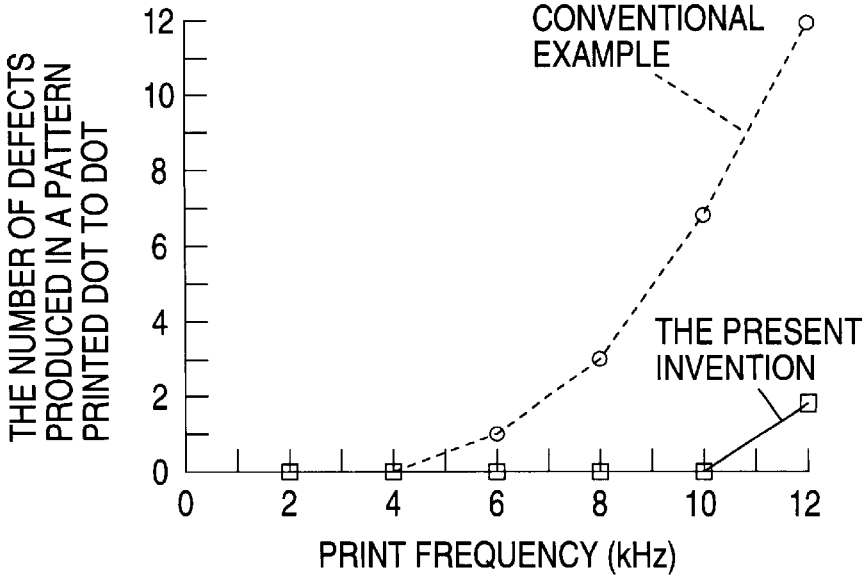
FIG. 8 is a graph showing frequency response capability when a pattern is printed dot to dot in the thermal ink-jet head according to the present invention.
Figure 9:
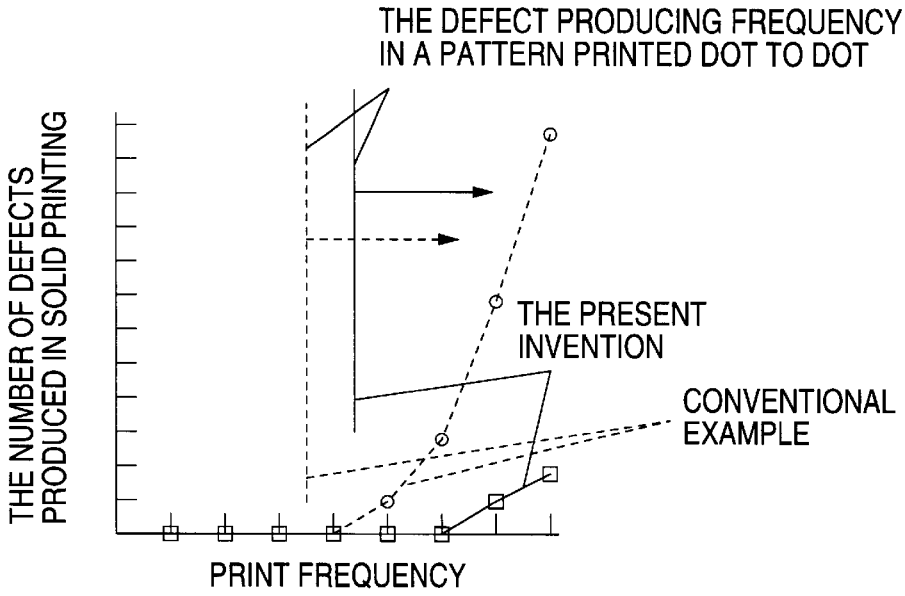
FIG. 9 is a graph showing frequency response capability at the time of solid printing in the thermal ink-jet head according to the present invention.

FIGS. 8 and 9 are graphs showing frequency response capability in the case of the thermal ink-jet head according to the present invention. FIG. 8 shows the relationship between the print frequency and the number of defects produced in a case where a pattern is printed dot to dot. FIG. 9 shows the relationship between the print frequency and the number of defects produced in the case of solid printing. Image quality has been affected by crosstalk in the conventional head when a pattern is printed dot to dot even when the print frequency is low. Even in the case of solid printing, printing defects such as dropouts have been produced as the print frequency becomes higher when a refill of ink is conducted. As shown in FIGS. 8 and 9, however, the thermal ink-jet head according to the present invention allows no defects to be produced and is capable of maintaining image quality even at high print frequencies heretofore resulting in producing defects. Therefore, it becomes possible to improve the defect-producing frequency greatly in the half-tone and solid printing portions that have previously posed a serious problem on the conventional head. More specifically, the thermal ink-jet head according to the present invention can be operated up to levels of about 10–12 kHz practically without producing image defects. When characters and the like are printed, a print frequency of approximately 20 kHz is possible in such a character mode because a high ink flow rate is not required for a graphic pattern, that is, for solid, half tone and so forth.

Figure 10:
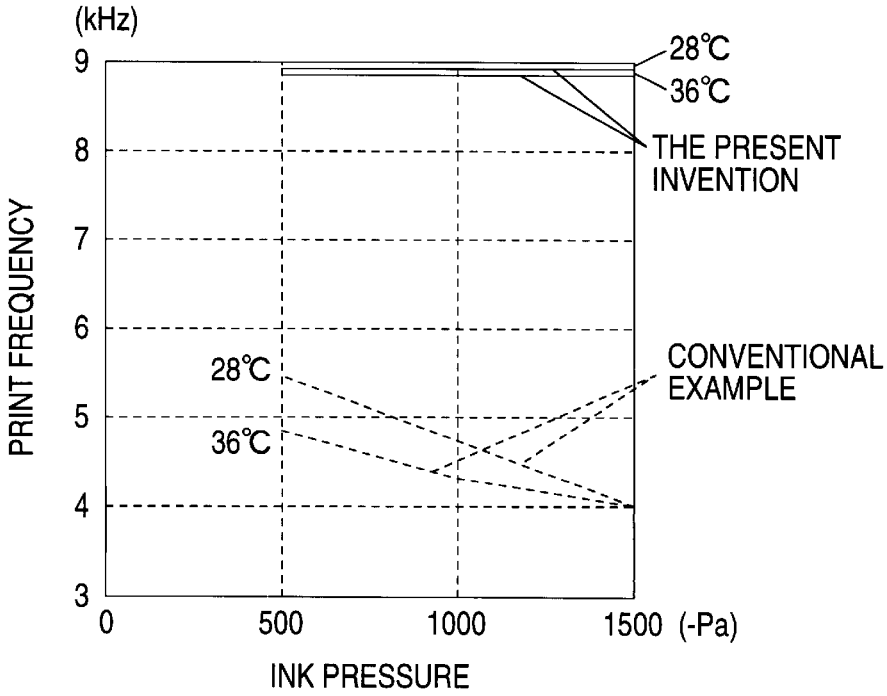
FIG. 10 is a graph showing the relationship between the internal head pressure and print frequencies resulting in producing printing defects in the thermal ink-jet head according to the present invention.

FIG. 10 is a graph showing the relationship between the internal head pressure and print frequencies resulting in producing printing defects. When a bubble dies out after ink is discharged, the quantity of ink corresponding to what has been discharged is required to flow onto the heating element 1. In other words, a refill of ink is conducted. Then the ink in the nozzle flow channel 5 is drawn into the nozzle when the absolute value of the negative pressure in the ink-jet head is large and caused to introduce air from the tip of the nozzle. A phenomenon of this kind will never occur if the ink is supplied from the ink reservoir 7 to the heating element 1 satisfactorily. Moreover, if the absolute value of the negative pressure is large, the propellent force of discharging the ink will be necessitated. Therefore, a nonconforming discharge may be brought about when the absolute value of the negative pressure becomes large unless the bubble pressure is utilized efficiently.

As shown by a broken line of FIG. 10, the conventional ink-jet head has developed printing defects generally at low print frequencies because a refill of ink is not accomplished satisfactorily. As bubble pressure has been utilized insufficiently, printing defects tend to become conspicuous as the absolute value of the negative pressure increases. That is, such printing defects are produced even at low print frequencies. However, no printing defects are produced generally even at high print frequencies according to the present invention as shown by a solid line of FIG. 10. Even when the absolute value of the negative pressure increases, no printing defects are produced. In other words, a refill of ink is conducted efficiently in the ink-jet head according to the present invention. Moreover the bubble pressure is seen to be utilized with efficiently.

Figure 11:
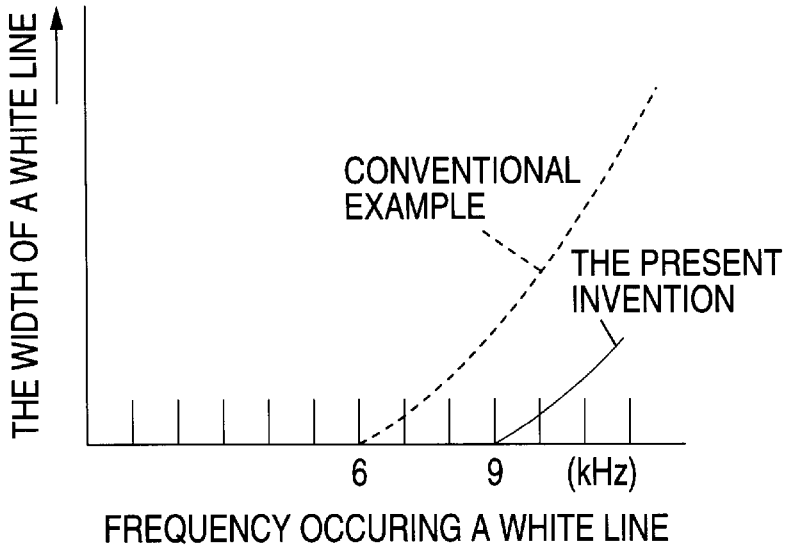
FIG. 11 is a graph showing the relationship between the print frequency and the appearance of a white line in the front position at the time of solid printing in the thermal ink-jet head according to the present invention.

FIG. 11 is a graph showing the relationship between the print frequency and the appearance of a white line in the front position at the time of solid printing in the thermal ink-jet head according to the present invention. As stated above in reference to FIGS. 16 and 17, such a white line appears in the front position when solid printing is performed at high print frequencies. As shown in FIG. 11, a white line is seen to appear roughly at 6 kHz in the conventional example, whereas no white line defect is found substantially up to approximately 9 kHz according in the present invention.

Figure 12:
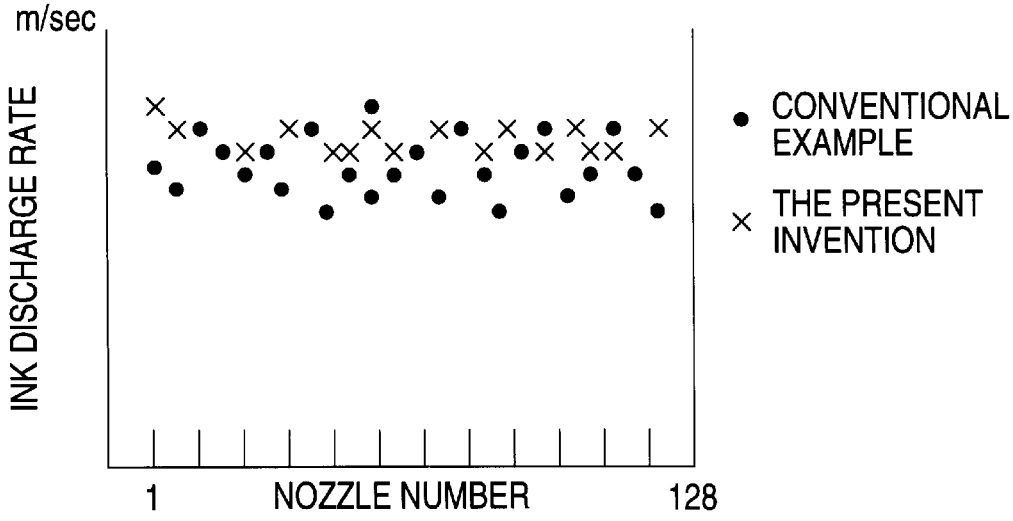
FIG. 12 is a graph showing the measured results of ink discharge rates in the respective nozzles of one head.

FIG. 12 is a graph showing the measured results of ink discharge rates in the respective nozzles of one head. As shown by black circles of FIG. 12, approximately 0.5 m/sec variation in standard deviation a has conventionally been observed in the case of a head having 128 nozzles. However, the standard deviation a in the thermal ink-jet head according to the present invention has been improved to roughly 0.2 as shown by x of FIG. 12. Variations in the ink discharge rate have so far been known as the results of reflection of variations in the workmanship of finished products of heads. Since the flow channel resistance as a resistance component sufficient for pressure propagation in a moment in which a bubble develops is situated in the rear of the heating element 1 without interfering with the refill flow, a structure not only insensitive to variation in such workmanship in the rear of the heating element 1 but also capable of determining a jet flow rate solely by the bubble forming condition has been attained. As a result, variations in the ink discharge rate are considered to be lowered as shown in FIG. 12. This means that image quality is improvable because an error in the dot position in the direction in which a carriage moves is reduced.

Figure 13:
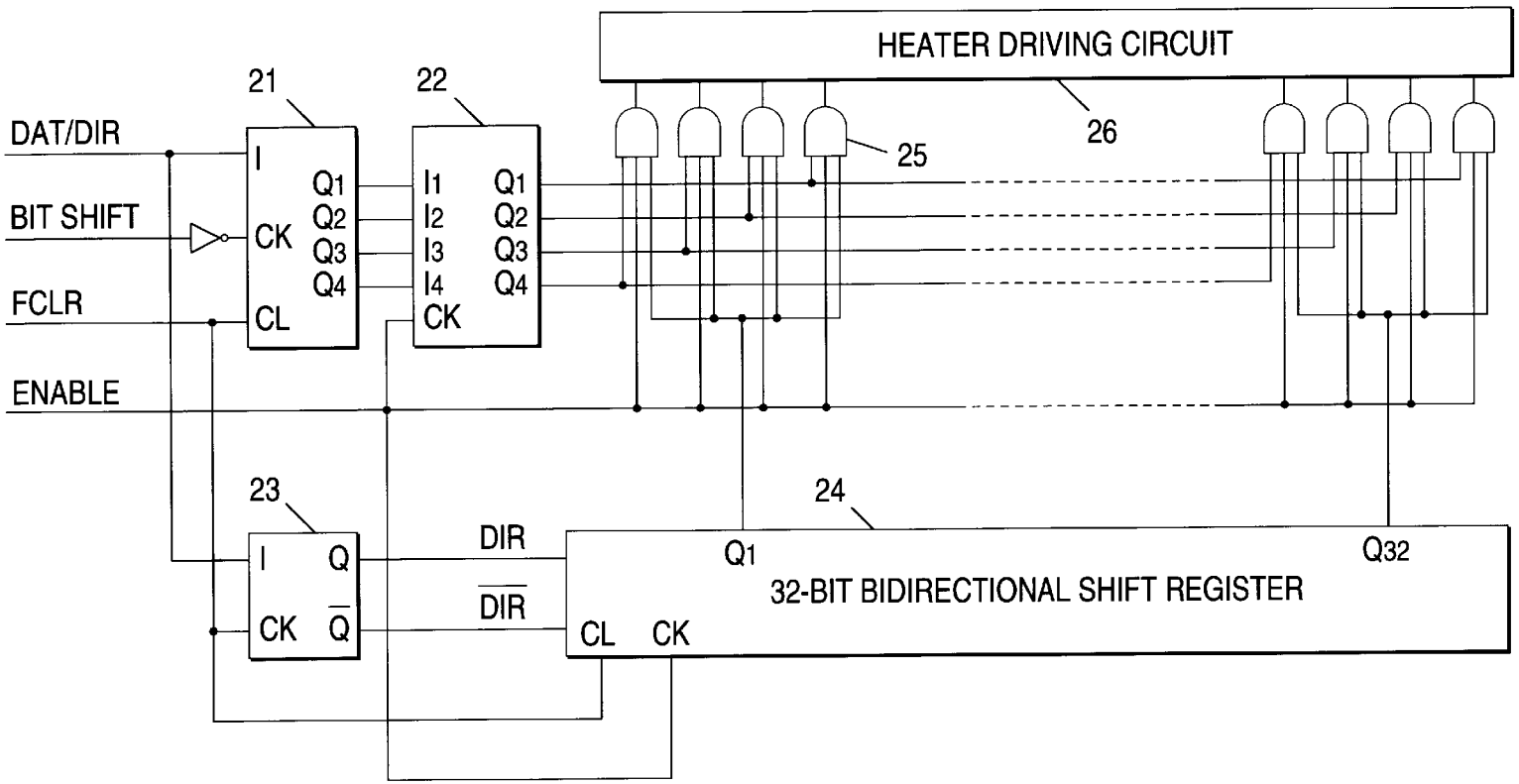
FIG. 13 is a block diagram of an exemplary control unit embodying the present invention.

FIG. 13 is a block diagram of an exemplary control unit embodying the present invention. Reference numeral 21 denotes a 4-bit shift register. Reference numerals 22, 23 denote latch circuits, reference numeral 24 denotes a 32-bit bidirectional shifter register, reference numeral 25 denotes AND circuits, and reference numeral 26 denotes a heater driving circuit. The aforementioned heating element 1 is controlled by a drive control unit as shown in FIG. 13. In this case, the drive control unit is used for sequentially driving the blocks with four nozzles as one block.

A DAT/DIR signal is a signal for indicating printing data or a scanning direction. A BIT SHIFT signal is for shifting the 4-bit shift register 21. A FCLR signal is for resetting the 4-bit shift register 21 and the 32-bit bidirectional shift register 24 and for latching the latch circuit 23. Further, an ENABLE signal is a timing signal for driving the nozzles, namely, 128 nozzles.

The AND circuits 25 correspond to the respective heating element 1 and its output is used to control the heater driving circuit 26. Since the blocks are sequentially driven with four nozzles as one block according to this embodiment of the invention, each of the output terminals Q1, . . . , Q32 is connected to four AND circuits 25.

The 4-bit shift register 21 and the 32-bit bidirectional shift register 24 are reset by the FCLR signal. When these registers rise, the latch circuit 23 latches the DIR signal, whereby the shifting direction of the 32-bit bidirectional shift register 24 is determined. Then image data is output as the DAT/DIR signal and the BIT SHIFT signal is input as a clock signal for the 4-bit shift register 21. For example, the image data are sequentially taken into 4-bit shift register 21 when the BIT SHIFT signal rises. When the 4-bit image data is taken in, it is latched in the latch circuit 22 when the ENABLE signal rises. The image data thus latched is fed into the AND circuit 25.

With the ENABLE signal as a clock signal, on the other hand, the 32-bit bidirectional shift register 24 is shifted and an output from any one of the output terminals Q1, . . . , Q32 is input to the AND circuit 25. Therefore, only the four AND circuits 25 in that one block selected by the 32-bit bidirectional shift register 24 are driven in response to the image data. Then the heater driving circuit 26 is driven only during the "H" period of the ENABLE signal so that the heating element 1 is actuated. The heat generated from the heating element 1 makes a bubble grow on the heating element 1 of the pit 2. The pressure generated when the bubble grows causes an ink drop to be discharged for the purpose of printing a character. Thus, the output terminals of the 32-bit bidirectional shift register 24 are shifted from one to another each time the ENABLE signal is input and the heating elements 1 are sequentially driven every four out of 32 blocks.

Figure 14A:
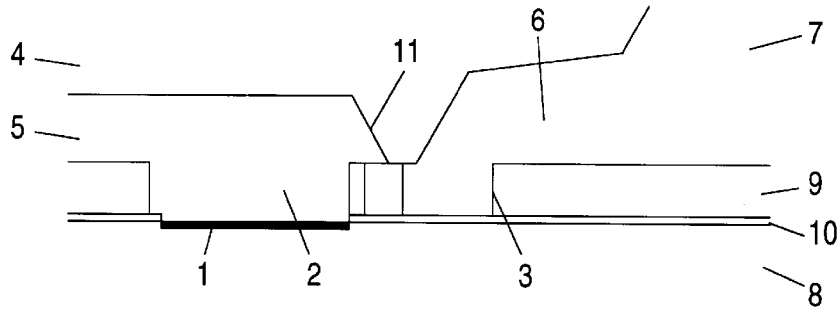
FIGS. 14A and 14B are schematic diagrams illustrating another thermal ink-jet head embodying the present invention.
Figure 14B:
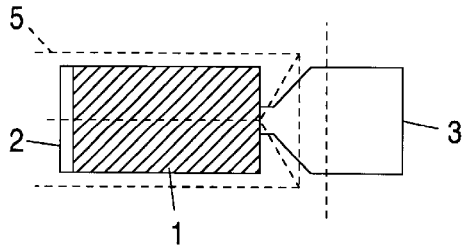

FIGS. 14A and 14B are schematic diagrams illustrating another thermal ink-jet head embodying the present invention. FIG. 14A is a sectional view of a portion near the pit 2. FIG. 14B is a top view of the pit 2. The polyimide wall 3 shown in FIGS. 3A–3D is linearly formed according to this embodiment of the invention. It is unnecessary to form the polyimide wall 3 into a substantially semicircle as shown in FIGS. 3A–3D and 6 because crosstalk can be lowered sufficiently with the throttled portion and the forward ink-reservoir portion 6 in this structure. Thus, the linear polyimide wall shown in FIGS. 14A and 14B is readily manufactured.

Figure 15A:
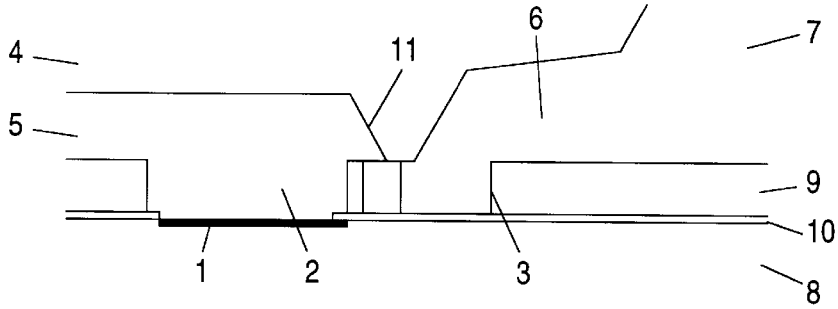
FIGS. 15A and 15B are schematic diagrams illustrating still another thermal ink-jet head embodying the present invention.
Figure 15B:
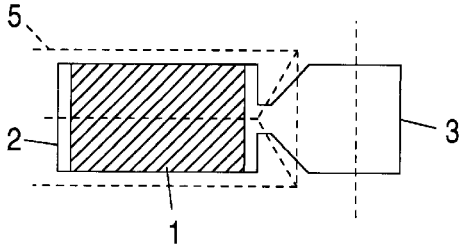

FIGS. 15A and 15B are schematic diagrams illustrating still another thermal ink-jet head embodying the present invention. FIG. 15A is a sectional view of a portion near the pit 2. FIG. 15B is a top view of the pit 2. Since an adhesive agent is used to join the channel wafer 4 and the synthetic resin layer 9 together, it may jut out on the heating element 1. In order to secure stability during the process of manufacture, a margin area needs setting accordingly because of the jutting-out of the adhesive agent. As shown in FIGS. 15A and 15B, a non-heating area approximately 10 $\mu$m wide is provided in the rear of the heating element 1 and a back portion of the throttled portion of the synthetic layer 9 is shifted backward and besides the length of the nozzle flow channel 5 is increased by 10 microns accordingly. In this case, the length h of the unetched portion is set to 50 microns to the extent that the flow channel resistance becomes lower than what is shown in FIGS. 3A to 3D and 14. Consequently, the adhesive agent is prevented from jutting out on the heating element 1 which results in reducing variations during the process of manufacture. Not only a higher frequency response capability but also a reduction in crosstalk is secured by the throttled portion of the pit 2 and the unetched portion as stated previously even in this case.

The aforesaid thermal ink-jet head is, as shown in each embodiment of the invention, designed to make the ink supply port of the channel wafer 4 communicate with an ink tank to facilitate the ink flow by bonding an ink supply means (not shown) to the ink supply port thereof. While the thermal ink-jet head or recording paper is kept moving, the heating element 1 is supplied with power to generate heat according to the image data and ink is caused to be discharged from the nozzles for recording data by means of the ink supply means fitted to the recording apparatus. Thus, the recording apparatus furnished with the thermal ink-jet head according to the present invention is capable of making obtainable stable, high-quality printed images at all times.

As is obvious from the description given of the present invention, the ink jetting force is improved as the bubble energy is utilizable for the discharge of ink with certainty and the printing operation can stably be performed by dealing with external disturbance such as the drying of the nozzle and ink leakage. Further, pit-to-pit crosstalk is obviated and the discharge of ink is stabilized without relying on the print pattern. In addition, high-speed printing is made feasible by high frequency response capability. Further, the location of an optimum flow channel in the rear of the heating element results in stabilizing the ink flow in the vicinity of the heating element and thus providing a print head far free from poor image quality. Further, the head can be made small-sized and inexpensive as the whole flow channel length is reduced. Since the formation of only one opening is required for each nozzle in the synthetic resin layer, variations during the process of manufacture are reduced with the effect of manufacturing products with stability.

What is claimed is:

1. A thermal ink-jet head comprising:

a heater substrate having heating elements that produce bubbles;

a channel substrate having a plurality of nozzle flow channels, an ink reservoir, the ink reservoir being common to communicating directly with each nozzle flow channel, a plurality of ink supply ports, and a slanted wall, wherein each of said nozzle flow channels is formed in said channel substrate, said nozzle flow channels being located above said heating elements and extending substantially to an end portion of said heating elements, said end portion being proximate to said ink reservoir, an ink flow channel is provided in at least said heater substrate, the ink flow channel extending substantially from the end of said heating elements to said ink reservoir, and a throttle portion is formed within said ink flow channel, the throttle portion having a sectional area that decreases in size between said heating elements and said ink reservoir, said throttle portion being defined in said heater substrate and between said heater substrate and said slanted wall of said channel substrate.

2. The thermal ink-jet head of claim 1 wherein a sectional area of said ink reservoir decreases proximate to said ink flow channel.

3. The thermal ink-jet head of claim 1, wherein said ink reservoir provides ink to said plurality of nozzle flow channels.

4. The thermal ink-jet head of claim 1, wherein the sectional area of said throttle decreases in size from said ink reservoir to substantially the end of said heating elements, said nozzle flow channel has a tilted side wall extended in a direction perpendicular to a direction in which said nozzle flow channel extends, and a tapered wall forming part of said ink-reservoir is situated above a portion of said throttle where the sectional area begins to decrease.

5. A thermal ink-jet head comprising:

a heater substrate having heating elements;

a channel substrate having a plurality of ink supply ports, an ink reservoir, a plurality of nozzle flow channels, the ink reservoir being common to communicating directly with each nozzle flow channel, and a slanted wall, wherein said channel substrate is formed with at least said plurality of nozzle flow channels disposed therein, said nozzle flow channels extending to respective end portions of said heating elements, the ink supply ports and said ink reservoir supplying ink to said plurality of nozzle flow channels, a sectional area of said ink reservoir communicating with said ink supply ports being increased from said ink supply port toward said nozzle flow channel, a synthetic resin layer is provided on a heater substrate, the heating elements also being provided on said heater substrate, and an ink flow channel having a throttle is formed in said ink flow channel, said ink flow channel and said throttle being provided in said heater substrate, said throttle being defined between the heater substrate and the slanted wall of the channel substrate, said throttle extending from substantially the end portion of said heating elements to substantially said ink reservoir formed in said channel substrate, and a sectional area of the throttle decreases in size in a direction from said ink reservoir to said heating elements.

6. A combination of a recording apparatus and a thermal ink-jet head, said recording apparatus comprising a housing and an ink tank placed in said housing, said ink tank having openings, said thermal ink-jet head comprising:

a heater substrate having heating elements that produce bubbles; and a channel substrate having a plurality of nozzle flow channels, an ink reservoir, a plurality of ink supply ports and a slanted wall, the ink supply ports communicating with the openings of said ink tank, the ink reservoir being common to communicating directly with each nozzle flow channel, wherein each of said nozzle flow channels are formed in said channel substrate, said nozzle flow channels extending above the heating elements to substantially an end of said heating elements, and an ink flow channel is provided in at least said heater substrate, said ink flow channel forming a throttle between the heater substrate and the slanted wall of the channel substrate, a sectional area of the throttle being decreased in size as it approaches said heating elements from said ink reservoir.

7. A thermal ink-jet head comprising:

heating elements formed in a heating substrate, said heating elements being disposed in a pit formed in the said heating substrate;

an ink reservoir;

a channel substrate having a slanted wall and a plurality of nozzle flow channels having a portion disposed above said heating elements, the ink reservoir being common to communicating directly with each nozzle flow channel; and an ink flow channel between said ink reservoir and said nozzle flow channel, said ink flow channel forming a pathway so that ink flows between said ink reservoir and said nozzle flow channel, a throttle being formed within said ink flow channel between the heating substrate and the slanted wall of the channel substrate, said throttle having a sectional area that varies in size between said ink reservoir and said nozzle flow channel.

8. The ink-jet head of claim 7, further comprising a cut away section provided in said heating substrate proximate to an end of said heating elements opposing said ink flow channel.

9. The ink-jet head of claim 7, wherein said nozzle flow channel has a tapered wall extending perpendicular to a direction of ink flow in said nozzle flow channel.

10. The ink-jet head of claim 7, further comprising a tapered channel pressure wall formed at an end of said nozzle flow channel and substantially above the end of said heating elements.

11. The ink-jet head of claim 10, wherein said throttle is disposed substantially below said tapered channel pressure wall.

12. The ink-jet head of claim 10, wherein said tapered channel pressure wall controls a growth of a bubble produced on said heating element.

13. The ink-jet head of claim 12, wherein said channel pressure wall reflects the bubble toward an ink discharge port.

14. The ink-jet head of claim 12, wherein the throttle causes the bubble to form in a direction of the ink discharge port.

15. The ink-jet head of claim 7, wherein a portion of the ink flow channel forms the pit.

16. The ink-jet head of claim 7, wherein the sectional area of the throttle decreases in size from said ink reservoir to said tapered channel pressure wall.

* * * * *